United States Patent [19]

Jimenez et al.

[11] Patent Number: 4,850,730

[45] Date of Patent: Jul. 25, 1989

[54] DISPOSABLE TOOTHBRUSH

[76] Inventors: Francisco G. Jimenez, G.P.O. Box 4805, San Juan, P.R. 00936; George Spector, 233 Broadway RM 3815, New York, N.Y. 10007

[21] Appl. No.: 185,393

[22] Filed: Apr. 25, 1988

[51] Int. Cl.[4] ..... A46B 11/02

[52] U.S. Cl. ..... 401/184; 401/186; 401/287; 401/131; 401/195; 222/106

[58] Field of Search ..... 222/94, 191, 192, 106, 222/206, 207, 210, 212, 215; 132/84 B, 84 R; 401/183, 184, 186, 286, 287

[56] References Cited

U.S. PATENT DOCUMENTS

| | | | |
|---|---|---|---|
| 2,317,002 | 4/1943 | Uluick | 401/184 |
| 2,321,265 | 6/1943 | Uluick | 401/184 |
| 2,607,513 | 8/1952 | Lawson | 222/212 |
| 2,733,722 | 2/1956 | Rodd | 222/206 |
| 2,743,042 | 4/1956 | Burgin | 222/191 |
| 2,813,290 | 11/1957 | Aschenbach | 401/184 |
| 3,081,006 | 3/1963 | Land | 222/491 |
| 4,150,741 | 4/1979 | Rubin | 194/294 |
| 4,176,980 | 12/1979 | O'Neal et al. | 401/287 |
| 4,582,075 | 4/1986 | O'Neal et al. | 132/84 B |

*Primary Examiner*—Andres Kashnikow
*Assistant Examiner*—Karen B. Merritt

[57] ABSTRACT

A disposable toothbrush is provided and consists of a handle with a reservoir therein for holding toothpaste therein whereby the toothpaste can be discharged through the toothbrush into the bristles in the head by a person holding the handle and squeezing flexible portions along the handle thus controlling the amount of toothpaste used.

2 Claims, 1 Drawing Sheet

Fig. 1
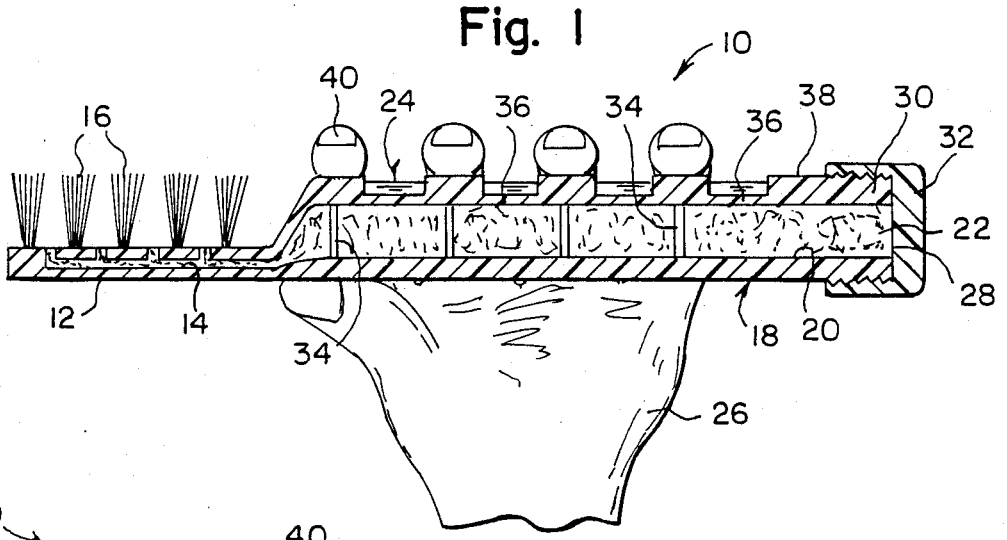
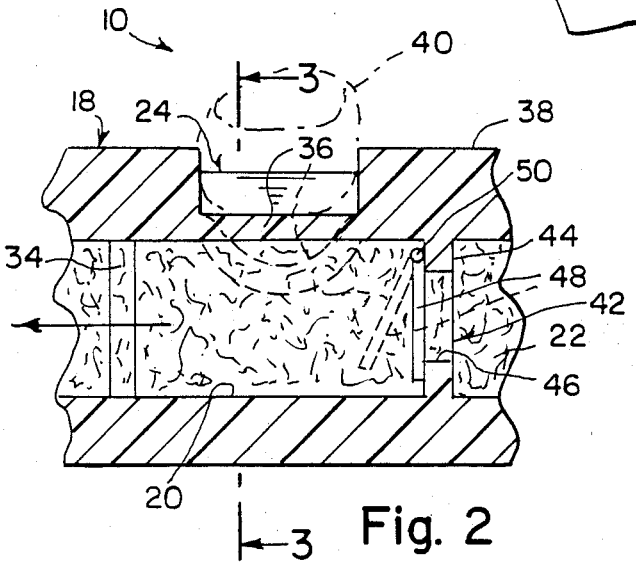
Fig. 2
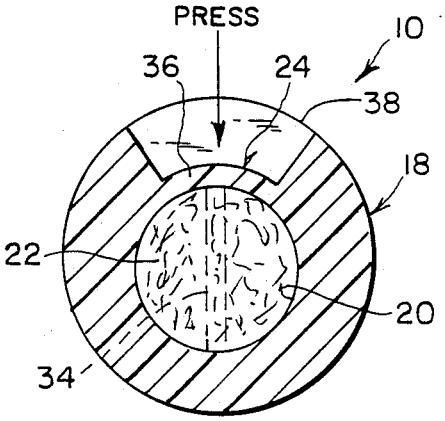
Fig. 3
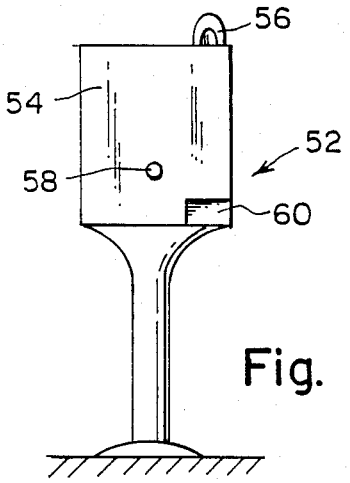
Fig. 4

DISPOSABLE TOOTHBRUSH

BACKGROUND OF THE INVENTION

The instant invention relates generally to toothbrushes and more specifically it relates to a disposable toothbrush.

Numerous toothbrushes have been provided in prior art that are adapted to come with a supply of toothpaste to be used in conjunction with brushing of the teeth. For example, U.S. Pat. Nos. 2,450,002; 3,937,235 and 4,530,129 are all illustrative of such prior art. While these units may be suitable for the particular purpose to which they address, they would not be as suitable for the purposes of the present invention as heretofore described.

SUMMARY OF THE INVENTION

A primary object of the present invention is to provide a disposable toothbrush that will overcome the shortcomings of the prior art devices.

Another object is to provide a disposable toothbrush in which toothpaste disposed within the handle can be discharged through the toothbrush into the bristles by a person holding onto the handle and squeezing flexible portions of the handle thus controlling the amount of toothpaste used.

An additional object is to provide a disposable toothbrush which could be dispensed from a vending machine such as in a rest room in hotels, motels, restaurants, airports, universities, etc.

A further object is to provide a disposable toothbrush that is simple and easy to use.

A still further object is to provide a disposable toothbrush that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a side cross sectional view of the invention held in the hand.

FIG. 2 is an enlarged cross sectional view showing details of one of the flexible segments in the handle with a reservoir support strut and a reservoir support valve member therein.

FIG. 3 is a cross sectional view taken along line 3—3 in FIG. 2 showing the reservoir support strut in dotted lines.

FIG. 4 is an elevational view of a vending machine for dispensing the disposable toothbrushes.

DETAILED DESCRIPTION OF THE PREFERRED EMBODIMENTS

Turning now descriptively to the drawings, in which similar reference characters denote similar elements throughout the several views, FIGS. 1, 2 and 3 illustrate a disposable toothbrush 10 consisting of a head portion 12 having a duct 14 therethrough. A plurality of bristles 16 extend from the head portion 12 for brushing teeth of a person using the toothbrush 10. An elongated handle

18 extends from the head portion 12 and has a reservoir 20 for storing toothpaste 22 therein. The reservoir 20 is fluidly connected to the duct 14. A discharge mechanism 24 is provided for sending the toothpaste 22 from the reservoir 20, through the duct 14 and into the bristles 16 by hand 26 of the person holding onto the handle 18.

The handle 18 has an opening 28 at distal end 30 thereof so that the toothpaste 22 can be inserted within the reservoir 20. A cap 32 is threaded onto the distal end 30 to seal the toothpaste 22 within the reservoir 20.

The discharge mechanism 24 includes a plurality of stiff support struts 34 spaced apart transversely within the reservoir 20. A plurality of flexible sections 36 are spaced apart along one side 38 of the handle 18. so that each of the flexible sections 36 is disposed between two of the support struts 34. When any of the flexible sections is depressed by a finger 40 of the hand 26 of the person holding onto the handle 18 the toothpaste 22 will enter the duct 14 and exit therefrom onto the bristles 16.

As shown in FIG. 2 a support valve member 42 is disposed within the reservoir 20 in place of one of the support struts 34. The support valve member 42 includes a stiff support wall 44 having an aperture 46 therethrough and a flap 48 hinged at 50 onto side of the support wall 44 adjacent the flexible sections 36 and opposite the distal end 30 of the handle 18. The flap 48 will open towards the head 12 of the toothbrush 10 when any of the flexible sections 36 behind the support valve member 42 is depressed thus allowing the toothpaste 22 coming from direction of the distal end 30 of the handle 18 to pass therethrough.

FIG. 4 shows a vending machine 52 consisting of a housing 54 to hold a plurality of the disposable toothbrushes 10 therein. A coin slot 56 is for receiving a proper amount of coinage for one of the disposable toothbrushes 10. A handle 58 is to activate a mechanism (not shown) to release one of the disposable toothbrushes 10 within the housing 54 when the proper amount of coinage is deposited. A door 60 in the housing is for receiving the disposable toothbrush 10 after the handle 58 is activated, thus allowing a person to remove the disposable toothbrush 10 from the door 60.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A disposable toothbrush comprising:

(a) a forward head portion having a duct therethrough;

(b) a plurality of bristles extending from said head portion for brushing teeth of a person using said toothbrush;

(c) an elongated handle extending rearwardly from said head portion, said handle having a reservoir for storing toothpaste therein, the reservoir being fluidly connected to the duct;

(d) means for discharging the toothpaste from the reservoir through the duct and into the bristles by hand of the person holding onto said handle;

(e) a plurality of transverse support struts longitudinally spaced within the reservoir underlying handle support portions and (f) a plurality of inwardly recessed flexible sections spaced apart along one side of said handle so that each of said flexible sections is inwardly disposed between successive support struts, whereby when any of said flexible sections is inwardly depressed by the user, toothpaste will enter the duct and exit therefrom onto said bristles and whereby the handle support portions are grasped in using the brush thus clearly indicating the location of said flexible sections for actuation.

2. A disposable toothbrush as recited in claim 1, further comprising at least one support valve member disposed within the the reservoir in place of at least one support strut, said support valve member including:

(a) a stiff support wall having an aperture therethrough; and (b) a normally closed check valve in said aperture which opens to provide flow of toothpaste to said head portion, responsive to inward depression of a said flexible section rearward of said valve.

* * * * *